United States Patent [19]

Ofir

[11] Patent Number: 4,875,681

[45] Date of Patent: Oct. 24, 1989

[54] HINGEDLY CONNECTED CUBICAL PRISMS AMUSEMENT AND DISPLAY DEVICE

[76] Inventor: Arie Ofir, 12 Hebron Rd., Jerusalem, Israel, 93542

[21] Appl. No.: 199,029

[22] Filed: May 26, 1988

[30] Foreign Application Priority Data

Feb. 29, 1988 [IL] Israel ..... 85585

[51] Int. Cl.[4] ..... A63F 9/08

[52] U.S. Cl. ..... 273/155; 446/119; 446/487

[58] Field of Search ..... 273/155, 146, 153 R, 273/153 S; 446/119, 487, 490

[56] References Cited

U.S. PATENT DOCUMENTS

| | | | |
|---|---|---|---|
| 3,201,894 | 8/1965 | Resch | 273/155 X |
| 3,550,310 | 12/1970 | Bock-Greissau | 446/487 X |
| 3,561,757 | 2/1971 | Schillig | 273/155 UX |
| 3,596,396 | 8/1971 | Thomson | 273/155 X |
| 3,774,332 | 11/1973 | Schneider | 40/152.1 |
| 3,940,142 | 2/1976 | Hinz et al. | 273/146 |

FOREIGN PATENT DOCUMENTS

| | | | |
|---|---|---|---|
| 1197895 | 7/1970 | United Kingdom | 273/155 |

*Primary Examiner*—Anton O. Oechsle

*Attorney, Agent, or Firm*—Kane, Dalsimer, Sullivan, Kurucz, Levy, Eisele & Richard

[57] ABSTRACT

The invention provides an amusement and display device comprising at least eight distinct elements each of the elements being of regular prismatic shape and having sides, edges and corners wherein each of the elements is interconnected to an adjacent element by flexible joining means provided along an edge thereof, at least two adjacent elements and least one of the elements being connected along three separate edges to three adjacent elements, characterized in that the elements are cubical prisms formed by interfitting two identical units of U-shaped profile mutually angularly offset by 90° and facing one another with their open ends and the joining means is a flexure hinge having two parallel edge grips and a connecting flexure web, an edge grip of one of the joining means being positioned adjacent an inner wall of one of the U-shaped units with its associated web overlying an edge adjacent thereto whereby when one of the U-shaped units is interfitted with an identical U-shaped unit the edge grip is retained within the body of the formed cubical element with its associated web clamped between adjacent interfitted edges of the interfitted units and each of the edges of the U-shaped unit are capable of being provided with an associated joining means and more then one joining means is simultaneously affixable to the body of the formed cubical element at right angle to each other.

11 Claims, 3 Drawing Sheets

HINGEDLY CONNECTED CUBICAL PRISMS AMUSEMENT AND DISPLAY DEVICE

The present invention relates to an amusement and display device.

More particularly the present invention relates to a device containing a plurality of interconnected elements of regular prismatic shape which are connected in sequence and susceptible of being maneuvered or manipulated in order to be brought collectively into a unique coherent composite structure.

Devices according to the present invention can have a variety of uses including serving as a geometrical puzzle or amusement device and/or as a display device.

A wide variety of geometrical puzzles are available. Many of these are commercially successful and intellectually stimulating as well as very appealing to numerous individuals whose curiosity and desire to solve problems or puzzles can be to a certain extent satisfied by currently available material.

Some of these puzzles are two-dimensional such as, for example, jig-saw puzzles the interlocking parts of which can be combined to represent pictures or the like. Others are three-dimensional puzzles wherein a collection of loose parts must be assembled to form a predetermined solid-geometrical shape such as a sphere or the like.

In the majority of available puzzles, the parts are either not attached to each other or are not constrained to cooperate in a manner which involves a relatively high level of skill for assembly. Furthermore, when the parts of such puzzles are detachable from one another, these parts can be lost or misplaced whereupon the remaining parts become useless or ineffective.

On the other side of the spectrum are the three-dimensional puzzles of the kind in which the solution requires the gradual transformation of the surface aspect of a solid from an initially randomized, meaningless agglomeration of surface features into a final state in which these features present an orderly, meaningful state.

The most recent and, indeed, most famous example of such a puzzle is of course, Rubik's Magic Cube, too well know to require introductory explanations. Despite its huge intial success, it is, however, slowly transpiring that, except for the select company of mathematicians, computer scientists and other specialists, the broad public is perceptibly becoming frustrated by the Cube's 43, 252, 003, 274, 489, 856,000 possibilities and it is reliably reported that the number of Magic Cubes gathering dust on upper shelves is (asymptotically, so far) approaching the number of newly acquired ones.

According to the present invention there is now provided an amusement and display device comprising at least eight distinct elements, each of said elements being of regular prismatic shape and having sides, edges and corners wherein each of said elements is interconnected to an adjacent element by flexible joining means provided along an edge thereof, at least two of said elements being connected along two separate edges to two adjacent elements and at least one of said elements being connected along three separate edges to three adjacent elements.

In a preferred embodiment of the present invention the joining means are designed and positioned to facilitate the rotation of a surface adjacent a joined edge 180° around an axis constituted by said edge.

Said joining means can be a simple hinge connecting two elements of the device according to the present invention or can be in the form of a strip of flexible material running along the outside surfaces of two adjacent elements.

Preferably said joining means is a flexure hinge having two parallel edge grips and a connecting flexure web, each of said grips being retained within the body of an element adjacent an edge thereof. In said preferred embodiment the web can be of plastic or cloth material and the edge grips can be made of similar or different material attached to the web or integral therewith as described hereinafter.

As will now be realized in the device according to the present invention the elements are permanently attached to each other and therefore cannot be lost but are adapted for limited physical displacement therebetween whereby the elements although capable of many various movements relative to each other nevertheless can be brought by only few limited sequences of movements to related positions in which they cooperatively constitute a desired solid geometrical structure.

The elements are preferably interconnected so as to enable the formation of a unique coherent composite structure of regular solid geometrical configuration in at least one predetermined target combination and/or to enable the formation of various pleasing arrangements of elements which arrangements need not be of regular solid geometrical configuration but can be of free standing form suitable for various displays including even of family pictures attached to exposed surfaces thereof.

In one embodiment of the present invention as described hereinafter with reference to the accompanying figures the elements are cubical prisms and a possible composite structure is also a cube.

In this embodiment an object to be achieved is a manipulation and collective positioning of the elements into a regular solid geometrical configuration which is symmetrical and a larger version of the configuration of the individual elements.

Segments of pictures may preferably be provided on the various surfaces of the interconnected elements which picture segments in at least one predetermined target combination form a composite picture on at least one of the surfaces thereof thereby facilitating the use of the device as a picture puzzle amusement device and/or a display or even as an advertisement display device.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 1:
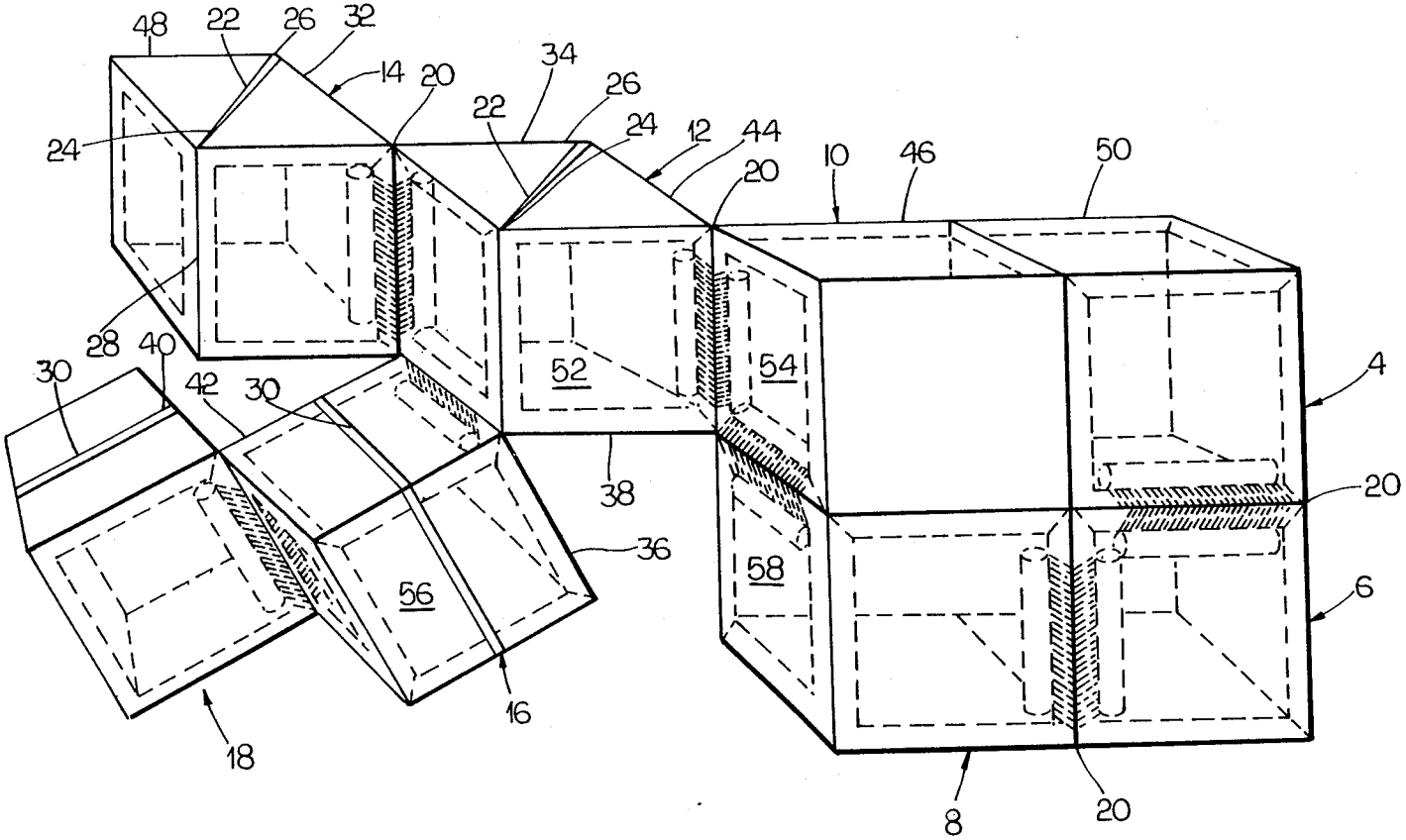
FIG. 1 is a perspective view of a preferred device according to the present invention.

Referring to FIG. 1 there is seen a device 2 according to the present invention.

The device is composed of eight distinct elements: 4, 6, 8, 10, 12, 14, 16 and 18 of regular prismatic shape. Each of the elements are interconnected to an adjacent element by flexible joining means 20 various embodiments of which are better seen with reference to FIGS. 3–6.

As will be noted in this embodiment, elements 6, 8, 10 and 14 are each connected along two separate edges to two adjacent elements and element 12 is connected along three separate edges to three adjacent elements 10, 14 and 16.

It will be realized that devices of the present invention can be prepared having various geometrical shapes and different interengagements.

Thus, while the illustrated embodiment is formed of eight cubical prisms, further similar elements could be added to form a more complex array and/or at least some of the elements could be subdivided into regular geometric shapes selected from rectangular and triangular subprisms, said subprisms being interconnected along edges thereof to adjacent prisms or subprisms.

Such possible further subdivisions are illustrated with regard to only some of the elements in FIG. 1 so that these possible embodiments can be better visualized and understood.

The double line 22 diagonally crossing the top of elements 14 and 12 and passing from one top corner 24, 24' to the opposite top corner 26, 26' illustrates how such an element could be subdivided into triangular prisms with double line 22 serving as a joined edge of the two triangular prisms. Alternatively edge 28 could serve as the joined edge of the two triangular prisms.

The double line 30 crossing the top of element 18 and the top and side of element 16 illustrates how such elements can be subdivided into rectangular prisms.

Referring still to FIG. 1, the device is shown in an arrangement wherein elements 4, 6, 8 and 10 have been maneuvered or manipulated to form a composite rectangular configuration with elements 12, 14, 16 and 18 yet to be manipulated to form a predetermined target combination of all eight elements.

As will be realized by rotating edge 32 of element 14 to touch edge 34 of element 12, edge 36 of element 16 to touch edge 38 of element 12 and edge 40 of element 18 to touch edge 42 of element 16 there is formed a composite rectangular configuration substantially at right angles to the elements 4, 6, 8 and 10.

By rotating all four elements 12, 14, 16 and 18 simultaneously so that edge 44 of element 12 touches edge 46 of element 10 and edge 48 of element 14 touches edge 50 of element 4, all eight elements combine to form a composite cubical structure.

Alternatively by rotating all four elements 12, 14, 16, 18 simultaneously so that surface 52 of element 12 touches surface 54 of element 10 and surface 56 of element 16 touches surface 58 of element 8, all eight elements combine to form a composite elongated rectangular structure.

When the elements of the device are cubical prisms there are two different preferred methods of manufacturing said elements which will now be discussed with reference to FIGS. 2 and 7.

Figure 2:
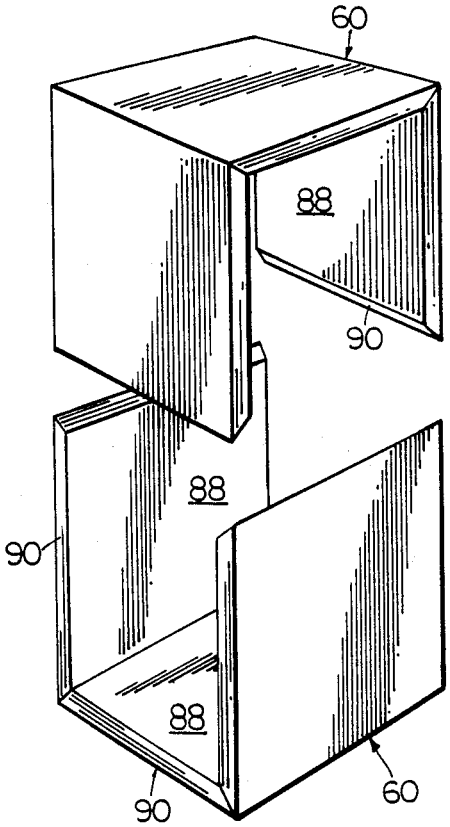
FIG. 2 is an exploded view of composite parts used to form an element of the present device.

Referring to FIG. 2 there are shown, before assembly, two identical units 60 of U-shaped profile which are shaped to be interfitted when they are mutually angularly offset by 90° and facing each other with their open ends as shown.

Figure 7:
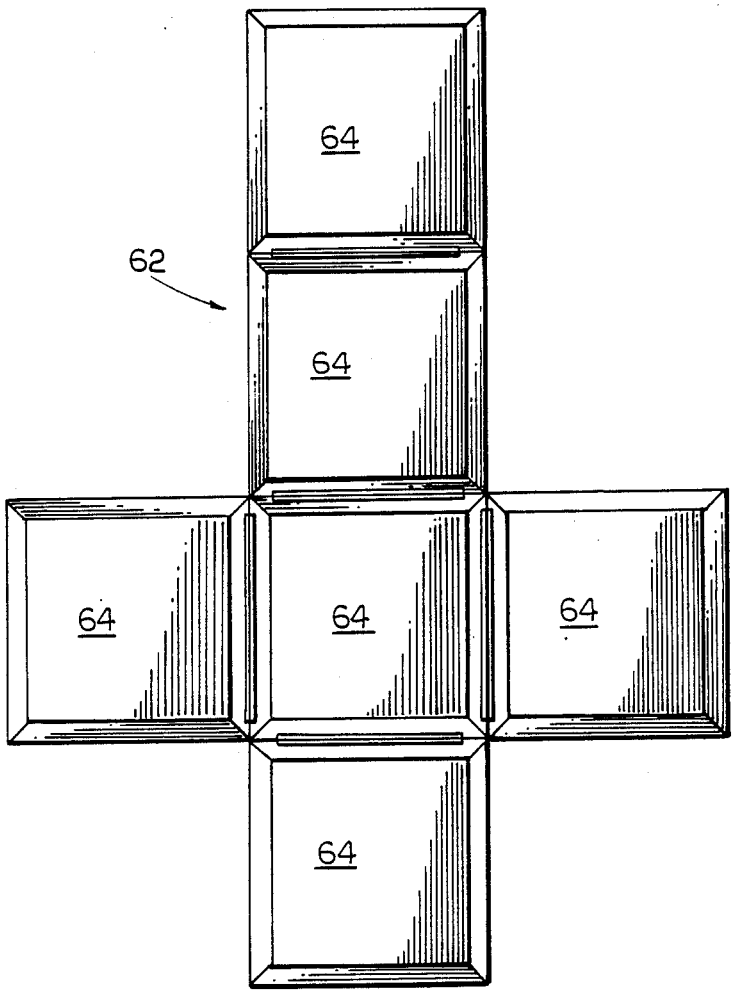
FIG. 7 is a plan view of a blank for forming an element of the present device.

In FIG. 7 there is seen a blank 62 having six hinged panels 64 which can be folded and interlinked by locking means (not shown) into a cubical prism.

In FIGS. 3–6 there are shown different types of flexure hinges which have been specially designed for the device of the present invention. All have in common that they have two parallel edge grips 66, 68, 70 and 72 respectively and a connecting flexure web 74, 76, 78, 80 respectively.

Figure 6:
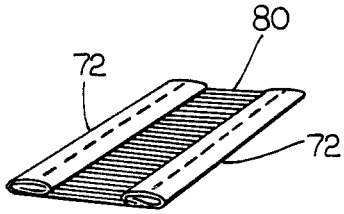

The hinge of FIG. 6 is formed from a strip of cloth the ends of which are respectively folded or rolled upon themselves and then sewn together to form edge grips 72, with a cloth web 80 remaining therebetween.

Figure 5:
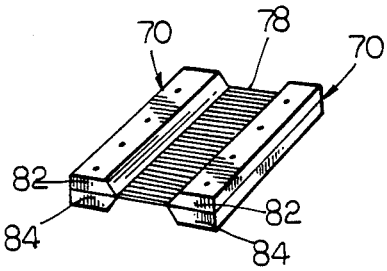

The hinge of FIG. 5 is formed from a strip of cloth 78 the ends of which are each clamped and riveted between a pair of support bars 82, 84 made of rigid plastic or even wood.

Figure 4:
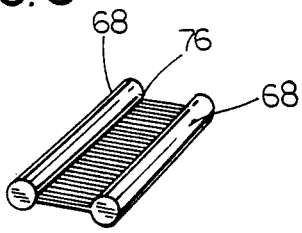

The hinge of FIG. 4 is made of molded polypropylene the web 76 of which is completely flexible and the edge grips 68 of which are held in place in the element by virtue of their thickened profile.

Figure 3:
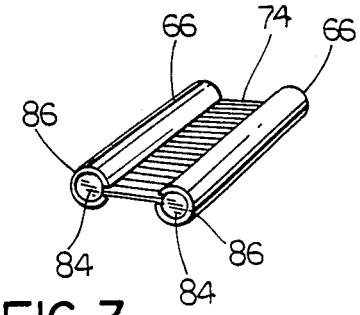
FIG. 3–6 are perspective views of various embodiments of joining means of the present invention.

The hinge of FIG. 3 is formed from a strip of polypropylene the edges of which are wound around a rigid locking rod 84 which is wedge into a clamping profile 86.

Referring again to FIG. 2 it will be understood that in assembling the devices of the present invention an edge grip of one of the above joining means is placed adjacent an inner wall 88 of one of the U-shaped units 60 of FIG. 2 with the web 74, 76, 78, 80 overlying an edge 90 adjacent thereto whereby when said unit 60 is interfitting with an identical element as shown the edge grip is retained within the body of the formed cubical element.

This process is then repeated with the other edge grip of said joining means and thereby two elements are joined together. In a similar manner further elements are interconnected to form the desired array.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An amusement and display device comprising at least eight distinct elements each of said elements being of regular prismatic shape and having sides, edges and corners wherein each of said elements is interconnected to an adjacent element by flexing joining means provided along an edge thereof, at least two of said elements being connected along two separate edges to two adjacent elements and at least one of said elements being connected along three separate edges to three adjacent elements, wherein said elements are cubical prisms formed by interfitting two identical units of U-shaped profile mutually angularly offset by 90° and facing one another with their open ends and said joining means is a flexure web, an edge grip of one of said joining means being positioned adjacent an inner wall of one of said U-shaped units with its associated web overlying an edge adjacent thereto whereby when one of said U-shaped units is interfitted with an identical U-shaped unit the edge grip is retained within the body of the formed cubical element with its associated web clamped between adjacent interfitted edges of said interfitted units.

2. An amusement and display device as claimed in claim 1, wherein said joining means facilitate the rotation of a surface adjacent a joined edge 180° around an axis constituted by said edge.

3. An amusement and display device as claimed in claim 1 wherein said elements are interconnected so as to form a unique coherent composite structure in at least one predetermined target combination.

4. An amusement and display device as claimed in claim 3 wherein said structure is a cube.

5. An amusement and display device as claimed in claim 3 wherein said structure is a rectangular prism.

6. An amusement and display device as claimed in claim 1 wherein at least some of said elements are subdivided into regular geometric shapes selected from rectangular and triangular subprisms, said subprisms being interconnected along edges thereof to adjacent prisms or subprisms.

7. An amusement and display device according to claim 1 wherein said web is of plastic material.

8. An amusement and display device according to claim 1 wherein said web is of cloth material.

9. An amusement and display device comprising:

a plurality of cubical prism elements including a first, a second, a third, a fourth, a fifth element, and a sixth element, each element having a plurality of edges and faces; and hinging means for interconnecting the cubical prisms and including:

a. a first hinge connected between an edge of said first element and a first edge of the second element;

b. a second hinge connected between a second edge of said second element and a first edge of said third element, said first and second edges of said second element being disposed along a common face of said second element;

c. a third hinge connected between a second edge of said third element and an edge of said fourth element, said first and second edges of said third element being disposed along different faces;

d. a fourth hinge disposed between a third edge of said second element and a first edge of said fifth element, said third edge being disposed along a different face from said common face of said second element; and e. a fifth hinge connected between a second edge of said fifth element and a first edge of said sixth element, said first and second edges of said fifth element being disposed along a common face.

10. The display device of claim 9 wherein said plurality of elements includes a seventh and an eighth element and said hinging means includes:

f. a sixth hinge connected between a second edge of said sixth element and a first edge of said seventh element, said first and said second edges of said sixth element being disposed along opposite faces of said sixth element; and g. a seventh hinge connected between a second edge of said of seventh element and a first edge of said eighth element, said first and second edges of said seventh element being disposed along a common face.

11. The display device of claim 9 wherein said plurality of elements consists of only eight elements and seven hinges.

* * * * *